US011254124B2

(12) United States Patent
Kuwayama et al.

(10) Patent No.: US 11,254,124 B2
(45) Date of Patent: Feb. 22, 2022

(54) LIQUID EJECTING DEVICE INCLUDING FIRST ENDMOST LIQUID EJECTING HEAD HAVING LIQUID EJECTING PORTION POSITIONED DEVIATED TOWARD SECOND ENDMOST LIQUID EJECTING HEAD

(71) Applicant: Brother Kogyo Kabushiki Kaisha, Nagoya (JP)

(72) Inventors: Tsuyoshi Kuwayama, Kasugai (JP); Yoshinori Osakabe, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/829,687

(22) Filed: Mar. 25, 2020

(65) Prior Publication Data

US 2020/0307193 A1 Oct. 1, 2020

(30) Foreign Application Priority Data

Mar. 29, 2019 (JP) ..... JP2019-066699
Mar. 29, 2019 (JP) ..... JP2019-066704

(51) Int. Cl.
*B41J 2/14* (2006.01)
*B41J 2/175* (2006.01)

(52) U.S. Cl.
CPC ..... *B41J 2/14* (2013.01); *B41J 2/175* (2013.01)

(58) Field of Classification Search
CPC . B41J 2/14; B41J 2/175; B41J 2/17553; B41J 2/17513
USPC ..... 347/20
See application file for complete search history.

(56) References Cited

U.S. PATENT DOCUMENTS 8,998,375 B2 4/2015 Amma et al.
2003/0007023 A1* 1/2003 Barclay ..... B41J 11/001 347/8
2005/0151796 A1* 7/2005 Kubo ..... B41J 2/17526 347/58

(Continued)

FOREIGN PATENT DOCUMENTS

EP 1234679 A2 8/2002
JP H08-244230 A 9/1996

(Continued)

*Primary Examiner* — Matthew Luu
*Assistant Examiner* — Alexander D Shenderov
(74) *Attorney, Agent, or Firm* — Banner & Witcoff, Ltd.

(57) ABSTRACT

A liquid ejecting device includes a plurality of liquid ejecting heads reciprocally movable in a main scanning direction and arrayed in the main scanning direction. Each of the plurality of liquid ejecting heads include a liquid ejecting portion configured to eject liquid. The plurality of liquid ejecting heads includes: a first endmost liquid ejecting head; and a second endmost liquid ejecting head. The first endmost liquid ejecting head constitutes one end in the main scanning direction of the plurality of liquid ejecting heads. The second endmost liquid ejecting head constitutes another end in the main scanning direction of the plurality of liquid ejecting heads. The liquid ejecting portion of at least one of the first endmost liquid ejecting head and the second endmost liquid ejecting head is disposed at a position deviated toward the remaining one of the first endmost liquid ejecting head and the second endmost liquid ejecting head.

14 Claims, 10 Drawing Sheets

(56) References Cited

U.S. PATENT DOCUMENTS

| | | | | |
|---|---|---|---|---|
| 2014/0333695 | A1 | 11/2014 | Amma et al. | |
| 2016/0152030 | A1* | 6/2016 | Nawano | B41J 2/1652 347/30 |

FOREIGN PATENT DOCUMENTS

| | | | |
|---|---|---|---|
| JP | 2014-240186 | A | 12/2014 |
| JP | 6312507 | B2 | 4/2018 |

* cited by examiner

LIQUID EJECTING DEVICE INCLUDING FIRST ENDMOST LIQUID EJECTING HEAD HAVING LIQUID EJECTING PORTION POSITIONED DEVIATED TOWARD SECOND ENDMOST LIQUID EJECTING HEAD

CROSS REFERENCE TO RELATED APPLICATION

This application claims priorities from Japanese Patent Application Nos. 2019-066699 filed Mar. 29, 2019 and 2019-066704 filed Mar. 29, 2019. The entire contents of the priority applications are incorporated herein by reference.

TECHNICAL FIELD

The present disclosure relates to a plurality of liquid ejecting heads, and a liquid ejecting device provided with the plurality of liquid ejecting heads.

BACKGROUND

Conventionally, there has been known a liquid ejecting device such as a printing device including a plurality of liquid ejecting heads such as ink cartridges having nozzles. Japanese Patent Application Publication No. 2014-240186 discloses such a liquid ejecting device in which two ink cartridges are detachably attachable. The two ink cartridges are provided so as to be reciprocally movable in a main scanning direction perpendicular to a direction in which a sheet on which an image is to be formed is conveyed. Further, there has also been known a so-called "off-carriage type" liquid ejecting device in which ink is supplied to a liquid ejecting head from an ink cartridge or an ink tank through a tube, and a so-called "on-carriage type" liquid ejecting device in which an ink cartridge is separately formed from a liquid ejecting head fixed onto a carriage and is attachable to and detachable from the carriage.

Each of the two ink cartridges described in Japanese Patent Application Publication No. 2014-240186 includes an ink nozzle unit having a plurality of nozzle openings. In this nozzle unit, a plurality of nozzle arrays are arrayed in the main scanning direction (i.e., a direction in which the ink cartridges are reciprocally moved), and each of the plurality of nozzle arrays is constituted by the plurality of nozzle openings arranged in a sub scanning direction (i.e., a direction in which a sheet is conveyed) perpendicular to the main scanning direction. Each of the ink nozzle units as configured above is provided at a center portion of a lower surface in the main scanning direction of the corresponding one of the ink cartridges.

In such type of the liquid ejecting device, an image forming region in which ink is ejected to the sheet is provided at a position between a capping region and a flushing region. In the capping region, the ink nozzle unit is covered by a cap to prevent dry up of the ink nozzle unit. In the flushing region, prescribed amount of ink is ejected from the ink nozzle unit to avoid defect in ejection of ink caused by thickening of the ink. The ink cartridges are reciprocally movable between the capping region and the flushing region.

SUMMARY

In the above type of liquid ejecting device, when the ink cartridges are moved to the capping region or the flushing region, a sufficient distance needs to be provided between the image forming region and the ink nozzle units of the ink cartridges at the capping region or the flushing region. Specifically, prescribed acceleration must be imparted on the ink cartridges in order to move back from the capping region or the flushing region to the image forming region. To this end, the sufficient distance, i.e., an accelerating region for accelerating the ink cartridges is required between the image forming region and ink nozzle units of the ink cartridges at the capping region or the flushing region in order to obtain sufficient acceleration.

However, with the ink cartridges where the ink nozzle units are disposed at the center portions of the lower surfaces of the ink cartridges, sufficient accelerating region cannot be provided unless a range in which the ink cartridges are reciprocally moved are sufficiently elongated, that is, unless the ink cartridges are configured to be moved to a position sufficiently away from the image forming region. Under such circumstances, size of the liquid ejecting device as a whole must be increased in order to obtain the sufficient accelerating region.

Further, in another aspect, there is likely that the recording medium such as the sheet passes through the image forming region in a state where the recording medium is not entirely positioned within the image forming region (i.e., a portion of the recording medium protrudes out of the image forming region) even when the printing operation is being normally performed. In such a case, a portion of the recording medium may contact with the cap provided at the capping region, and ink adhering to the cap may be adhered to the contact portion of the recording medium. In order to avoid adhesion of the ink to the recording medium, the ink nozzle units of the ink cartridges (i.e., a position where the cap is provided) must be positioned farther away from the image forming region.

However, with the configuration where the ink nozzle units are provided at the center portion of the lower surfaces of the ink cartridges, a range in which the ink cartridges are reciprocally moved needs to be elongated in order to position the ink nozzle units of the ink cartridges at positions sufficiently away from the image forming region. Hence, size of the liquid ejecting device as a whole must be increased in order to position the ink nozzle unit at a position away from the image forming region.

In view of the foregoing, it is an object of the present disclosure to provide a liquid ejecting head and a liquid ejecting device that can obtain a sufficient accelerating region for accelerating the liquid ejecting head without incurring increase in size of the liquid ejecting device.

Another object of the present disclosure is to provide a liquid ejecting head and a liquid ejecting device that can position a liquid ejecting unit of the liquid ejecting head at a position sufficiently away from an image forming region while maintaining size of the liquid ejecting device as a whole.

In order to attain the above and other objects, according to one aspect, the disclosure provides a liquid ejecting device including a plurality of liquid ejecting heads. The plurality of liquid ejecting heads are reciprocally movable in a main scanning direction and are arrayed in the main scanning direction. Each of the plurality of liquid ejecting heads include a liquid ejecting portion configured to eject liquid. The plurality of liquid ejecting heads includes: a first endmost liquid ejecting head; and a second endmost liquid ejecting head. The first endmost liquid ejecting head constitutes one end in the main scanning direction of the plurality of liquid ejecting heads. The second endmost liquid ejecting head constitutes another end in the main scanning direction of the plurality of liquid ejecting heads. The liquid ejecting portion of at least one of the first endmost liquid ejecting head and the second endmost liquid ejecting head is disposed at a position deviated toward the remaining one of the first endmost liquid ejecting head and the second endmost liquid ejecting head.

According to another aspect, the disclosure provides a set of liquid ejecting heads including: a first liquid ejecting head; and a second liquid ejecting head. The first liquid ejecting head includes a first liquid ejecting portion configured to eject liquid. The second liquid ejecting head includes a second liquid ejecting portion configured to eject liquid. The first liquid ejecting head and the second liquid ejecting head are reciprocally movable in a main scanning direction and are arrayed in the main scanning direction. At least one of the first liquid ejecting portion and the second liquid ejecting portion is at a position deviated toward the remaining one of the first liquid ejecting portion and the second liquid ejecting portion.

According to still another aspect, the disclosure provides a liquid ejecting device including: a plurality of liquid ejecting heads; and a plurality of caps. The plurality of liquid ejecting heads are reciprocally movable in a main scanning direction and are arrayed in the main scanning direction. Each of the plurality of liquid ejecting heads includes a liquid ejecting portion configured to eject liquid. The plurality of liquid ejecting heads are movable at least between: an image forming region in which each of plurality of liquid ejecting heads ejects the liquid; and a capping region. The plurality of liquid ejecting heads include: a first liquid ejecting head; and a second liquid ejecting head. The first liquid ejecting head includes a first liquid ejecting portion. The second liquid ejecting head includes a second liquid ejecting portion. The plurality of caps are provided at the capping region and are configured to cover the liquid ejecting portion of a corresponding one of the plurality of liquid ejecting heads. In a state where the plurality of liquid ejecting heads are positioned in the capping region, the first liquid ejecting head is positioned closer to the image forming region in the main scanning direction than the second liquid ejecting head is to the image forming region. The first liquid ejecting portion is at a position deviated toward the second liquid ejecting head.

According to still another aspect, the disclosure provides a set of liquid ejecting heads including: a first liquid ejecting head; and a second liquid ejecting head. The first liquid ejecting head includes a first liquid ejecting portion configured to eject liquid. The second liquid ejecting head includes a second liquid ejecting portion configured to eject liquid. The first liquid ejecting head and the second liquid ejecting head are reciprocally movable in a main scanning direction. The first liquid ejecting portion is at a position deviated toward the second liquid ejecting head.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
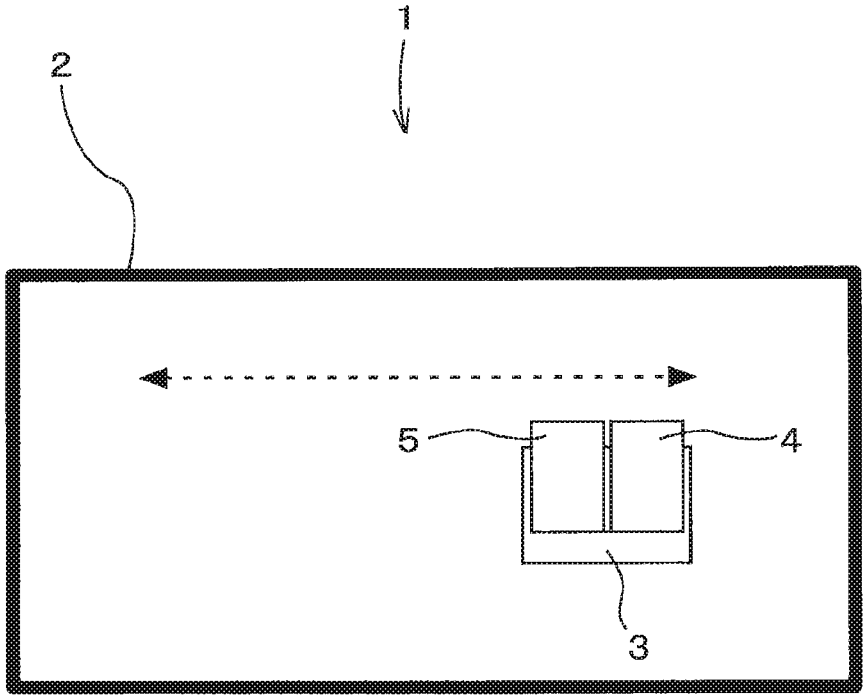
FIG. 1 is a schematic front vertical cross-sectional view illustrating a configuration of a liquid ejecting device according to one embodiment of the present disclosure.
Figure 1:
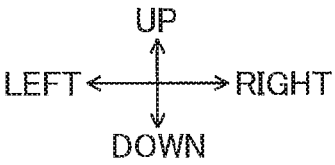

Hereinafter, a first embodiment of the present disclosure will be described with reference to the accompanying drawings. First, a liquid ejecting device 1 illustrated in FIG. 1 as an example of a liquid ejecting device is an image forming device so-called a printing device configured to form an image on an image recording medium such as a sheet S (see FIG. 2) by ejecting an ink as an example of a liquid.

The liquid ejecting device 1 includes a housing 2 having a rectangular parallelepiped shape and constituting an outer shell of the liquid ejecting device 1, and a carriage 3 positioned inside the housing 2. A conventional carriage moving mechanism (not illustrated) is positioned inside the housing 2 to reciprocally move the carriage 3 in a left-right direction as indicated by a broken line arrow in FIGS. 1 and 2. The direction in which the carriage 3 is reciprocally moved (i.e., the left-right direction) is an example of a main scanning direction. Further, a direction perpendicular to the main scanning direction (i.e., a front-rear direction) is an example of a sub scanning direction. Note that the front-rear direction is a conveying direction in which the sheet S is conveyed.

A plurality of ink cartridges (two ink cartridges 4 and 5 in the present embodiment) is attachable to and detachable from the carriage 3. The housing 2 has an upper opening (not illustrated), and a cover (not illustrated) for opening and closing the upper opening. By opening the cover, a user can perform, through the upper opening, maintenance work such as a replacement of the used ink cartridges 4 and 5 with new ink cartridges 4 and 5. The two ink cartridges 4 and 5 are arrayed on the carriage 3 along the main scanning direction (i.e., the left-right direction).

Each of the ink cartridges 4 and 5 is examples of a liquid ejecting head, a first liquid ejecting head, and a second liquid ejecting head. The ink cartridges 4 and 5 are positioned on each end portion of the carriage 3 in the main scanning direction. Hence, each of the ink cartridges 4 and 5 is also examples of an endmost liquid ejecting head, a first endmost liquid ejecting head, and a second endmost liquid ejecting head.

The ink cartridge 4 stores therein black ink as an example of liquid, and the ink cartridge 5 stores therein cyan ink, magenta ink, and yellow ink as examples of the liquid. The ink cartridge 4 is positioned on a right portion of the carriage 3, and the ink cartridge 5 is positioned on a left portion of the carriage 3 as viewed from a front side of the liquid ejecting device 1. Incidentally, instead of the above configuration, the ink cartridge 4 and the ink cartridge 5 may be positioned on the left portion and the right portion of the carriage 3, respectively.

Figure 2:
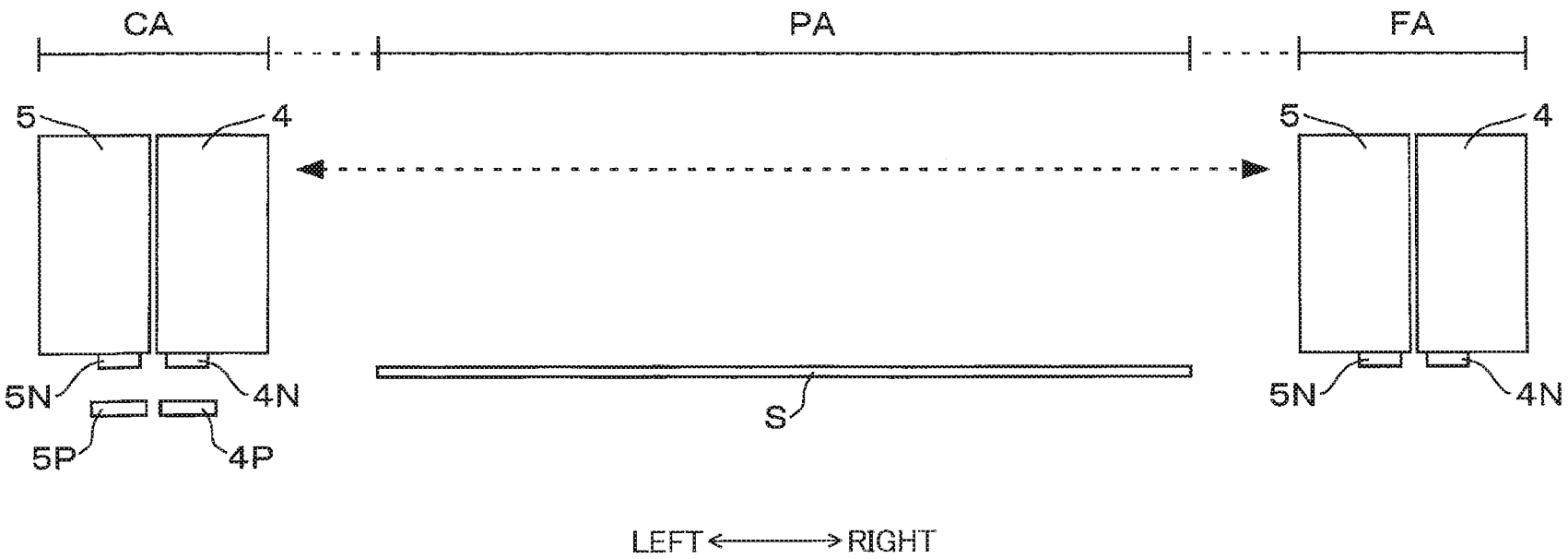
FIG. 2 is a schematic front view illustrating main components in the liquid ejecting device according to the embodiment.

As illustrated in FIG. 2, an ink nozzle portion 4N is provided at a lower surface of the ink cartridge 4. The lower surface of the ink cartridge 4 is a surface serving as a bottom surface of the ink cartridge 4 in a state where the ink cartridge 4 is mounted on the carriage 3. The ink nozzle portion 4N is configured to eject the liquid, i.e., black ink stored in the ink cartridge 4. Further, an ink nozzle portion 5N is provided at a lower surface of the ink cartridge 5. The lower surface of the ink cartridge 5 is a surface serving as a bottom surface of the ink cartridge 5 in a state where the ink cartridge 5 is mounted on the carriage 3. The ink nozzle portion 5N is configured to eject the liquid, i.e., cyan ink, magenta ink, and yellow ink those stored in the ink cartridge 5. Each of the ink nozzle portion 4N and the ink nozzle portion 5N is examples of a liquid ejecting portion, a first liquid ejecting portion, and a second liquid ejecting portion.

Further, the ink cartridges 4 and 5 are reciprocally movable in the left-right direction between a capping region CA and a flushing region FA defined in the liquid ejecting device 1 in a state where the ink cartridges 4 and 5 are mounted on the carriage 3. Further, an image forming region PA is defined between the capping region CA and the flushing region FA.

In the image forming region PA, the sheet S as the image forming medium (the printing medium) is conveyed in the front-rear direction by a conventional sheet conveying mechanism (not illustrated). Further, in the image forming region PA, inks stored in the ink cartridges 4 and 5 are ejected from the ink nozzle portions 4N and 5N onto the sheet S, respectively. The image forming region PA is an example of an image forming region.

In the present embodiment, the capping region CA is positioned leftward of the image forming region PA as viewed from the front side of the liquid ejecting device 1. Two caps 4P and 5P are provided in the capping region CA. Upon termination of printing operation, the ink cartridges 4 and 5 are moved to the capping region CA, whereupon the ink nozzle portion 4N and the ink nozzle portion 5N are covered with the cap 4P and the cap 5P, respectively. With this configuration, the ink nozzle portions 4N and 5N can be prevented from drying up.

The flushing region FA is positioned rightward of the image forming region PA as viewed from the front side of the liquid ejecting device 1. In a state where the ink cartridges 4 and 5 are moved to the flushing region FA, irrespective of when the printing operation is being performed or when the printing operation has already been completed, the ink nozzle portions 4N and 5N eject inks of prescribed amounts (hereinafter also simply referred to as "flushing operation"), thereby preventing the ink nozzle portions 4N and 5N from clogging up.

Further, during the printing operation, the ink cartridges 4 and 5 repeats reciprocating movement between the capping region CA and the flushing region FA as indicated by a broken line in FIG. 2. Even when the ink cartridges 4 and 5 are moved to the capping region CA during the printing operation, the ink nozzle portions 4N and 5N are not covered with the caps 4P and 5P, respectively. Further, when the ink cartridges 4 and 5 are moved to the flushing region FA during the printing operation, the flushing operation may be or may not be performed.

The liquid ejecting device 1 as described above have the following advantageous configurations with respect to positions of the ink nozzle portions 4N and 5N relative to the respective ink cartridges 4 and 5. Specifically, as illustrated in FIG. 2, the position of the ink nozzle portion 4N of the ink cartridge 4 is deviated leftward toward neighboring ink cartridge, i.e., the ink cartridge 5 so as to be positioned adjacent to the ink cartridge 5. On the other hand, the position of the ink nozzle portion 5N of the ink cartridge 5 is deviated rightward toward neighboring ink cartridge, i.e., the ink cartridge 4 so as to be positioned adjacent to the ink cartridge 4.

More specifically, when comparing positions of a center portion in the left-right direction of the ink cartridge 4 and a center portion in the left-right direction of the ink nozzle portion 4N, the center portion of the ink nozzle portion 4N is positioned closer to the ink cartridge 5 in the left-right direction than the center portion of the ink cartridge 4. Similarly, when comparing positions of a center portion in the left-right direction of the ink cartridge 5 and a center portion in the left-right direction of the ink nozzle portion 5N, the center portion of the ink nozzle portion 5N is positioned closer to the ink cartridge 4 in the left-right direction than the center portion of the ink cartridge 5.

In other words, in the state where the two ink cartridges 4 and 5 are moved to the capping region CA, the position of the ink nozzle portion 4N of the ink cartridge 4 which is positioned closer to the image forming region PA than the ink cartridge 5 is to the image forming region PA is deviated leftward toward the ink cartridge 5, i.e., deviated to be distant from the image forming region PA.

Further, in the state where the two ink cartridges 4 and 5 are moved to the flushing region FA, the position of the ink nozzle portion 5N of the ink cartridge 5 which is positioned closer to the image forming region PA than the ink cartridge 4 is to the image forming region PA is deviated rightward toward the ink cartridge 4, i.e., deviated to be distant from the image forming region PA.

Figure 3:
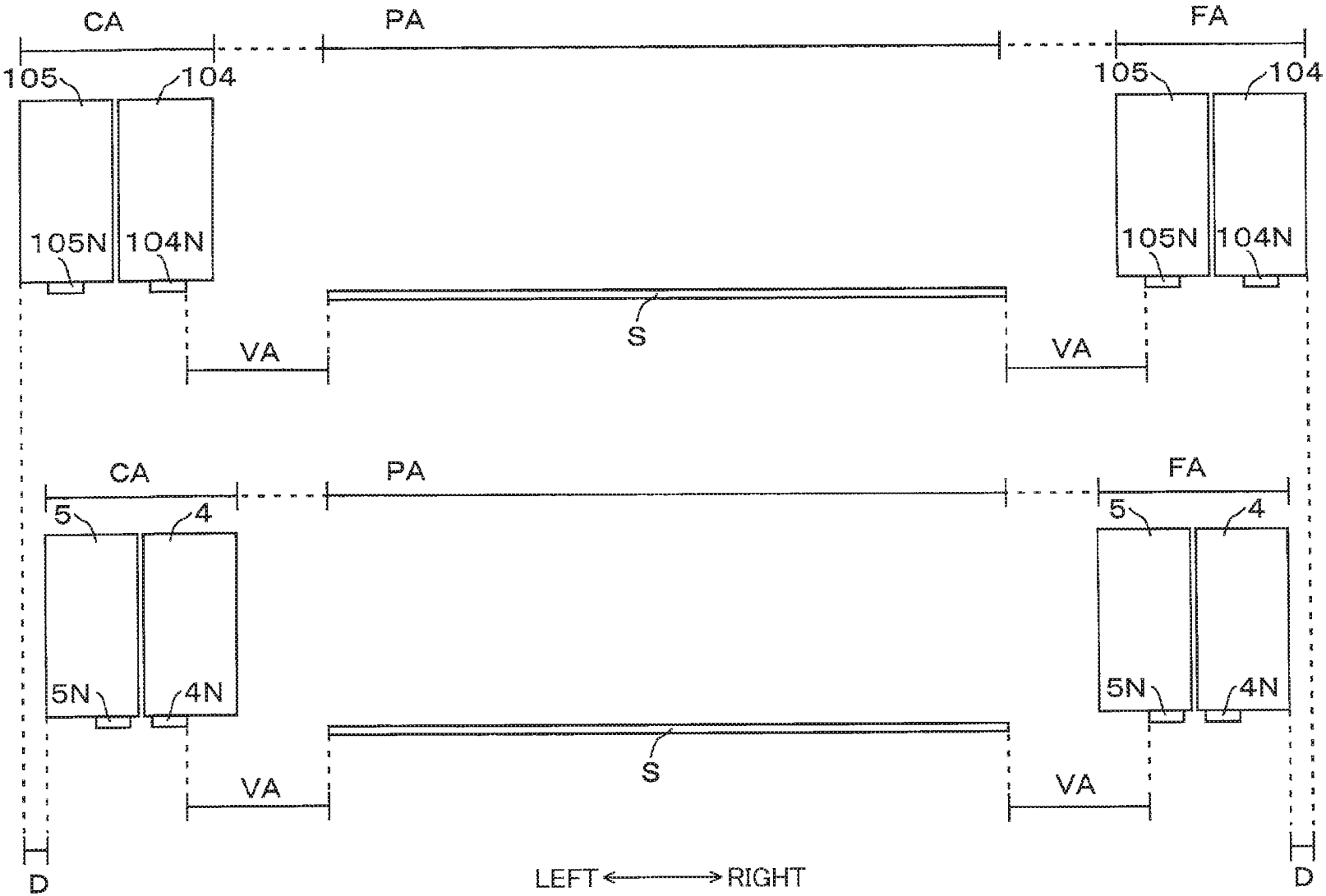
FIG. 3 is a schematic front view illustrating the main components in the liquid ejecting device according to the first embodiment and also illustrating corresponding main components of a conventional liquid ejecting device for the purpose of comparing the liquid ejecting device according to the first embodiment with the conventional liquid ejecting device.

According to the liquid ejecting device 1 as configured above, the following advantageous effects can be obtained. In FIG. 3, ink cartridges 104 and 105 provided in a conventional liquid ejecting device are illustrated at an upper portion, and the ink cartridges 4 and 5 of the liquid ejecting device 1 are illustrated at a lower portion. An ink nozzle portion 104N is disposed at a center portion in the left-right direction of the ink cartridge 104, and an ink nozzle portion 105N is disposed at a center portion in the left-right direction of the ink cartridge 105.

With the liquid ejecting device 1 according to the first embodiment, in comparison with a case where the conventional ink cartridges 104 and 105 are employed, an accelerating region VA for accelerating the ink cartridges 4 and 5 can be sufficiently obtained while avoiding increase in a length in which the ink cartridges 4 and 5 are reciprocally moved. In other words, the sufficient accelerating region VA for the ink cartridges 4 and 5 can be provided without incurring increase in size of the liquid ejecting device 1.

More specifically, in the liquid ejecting device 1 according to the first embodiment, the accelerating region VA equivalent to an accelerating region VA for accelerating the conventional ink cartridges 104 and 105 can be provided even when the length in which the ink cartridges 4 and 5 are reciprocally moved is made shorter than the range in which the conventional ink cartridges 104 and 105 by a distance D+D. Accordingly, with the above configuration, not only increase in size of the liquid ejecting device 1 as a whole can be restrained, but also compact liquid ejecting device 1 can be attained.

Figure 4:
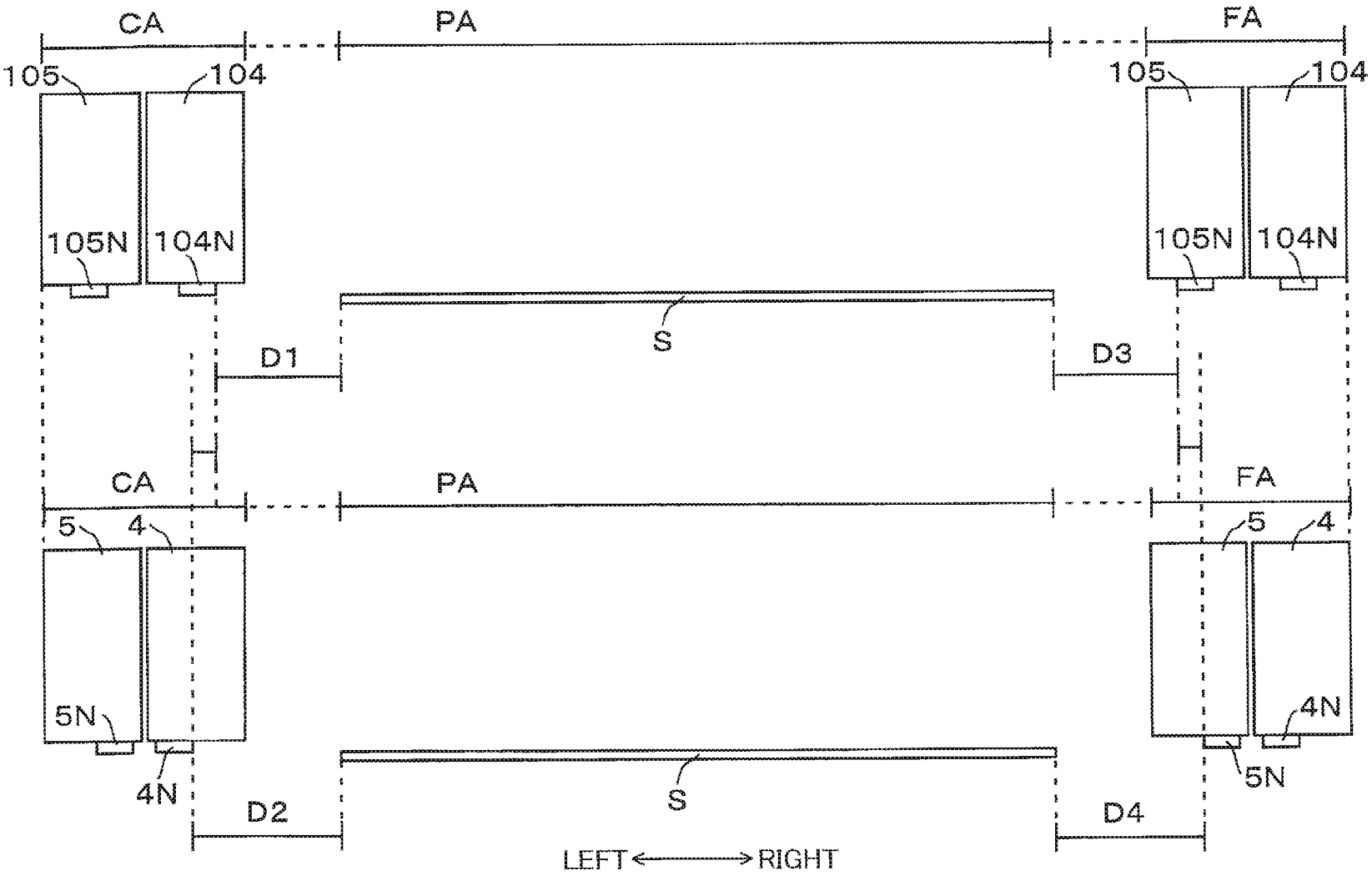
FIG. 4 is another schematic front view illustrating the main components of the liquid ejecting device according to the first embodiment and also illustrating the corresponding main components of the conventional liquid ejecting device for the purpose of comparing the liquid ejecting device according to the first embodiment with the conventional liquid ejecting device in another aspect.

In another aspect, according to the liquid ejecting device 1 as configured above, the following advantageous effects can also be exhibited. FIG. 4 also illustrates ink cartridges 104 and 105 in a conventional liquid ejecting device at an upper portion, and the ink cartridges 104 and 105 in the liquid ejecting device 1 according to the first embodiment. With the liquid ejecting device 1 according to the first embodiment, in comparison with a case where the conventional ink cartridges 104 and 105 are employed, the ink nozzle portions 4N and 5N can be positioned at positions sufficiently away from the image forming region PA in spite of the fact that the length in which the ink cartridges 4 and 5 are reciprocally moved is equivalent to a length in which the conventional ink cartridges 104 and 105 are reciprocally moved.

That is, in a state where the ink cartridges 4 and 5 are moved to the capping region CA, a gap distance D2 defined between the ink nozzle portion 4N and the image forming region PA is greater than a gap distance D1 defined between the conventional ink nozzle portion 104N and the image forming region PA. Therefore, the ink nozzle portions 4N and 5N of the ink cartridges 4 and 5 in the capping region PA can be positioned sufficiently away from the image forming region PA without enlarging the liquid ejecting device 1 as a whole. Consequently, the liquid ejecting device 1 according to the first embodiment can restrain ink adhered to the components in the capping region CA from adhering the recording medium disposed in the image forming region PA.

Similarly, in a state where the ink cartridges 4 and 5 are moved to the flushing region FA, a gap distance D4 provided between the ink nozzle portion 5N and the image forming region PA is greater than a gap distance D3 provided between the conventional ink nozzle portion 105N and the image forming region PA. Hence, the ink nozzle portions 4N and 5N of the ink cartridges 4 and 5 in the flushing region FA can be positioned at positions sufficiently away from the image forming region PA without enlarging the liquid ejecting device 1 as a whole. Consequently, the liquid ejecting device 1 as configured above can restrain ink adhered to the components in the flushing region FA from adhering the recording medium positioned in the image forming region PA.

Figure 5:
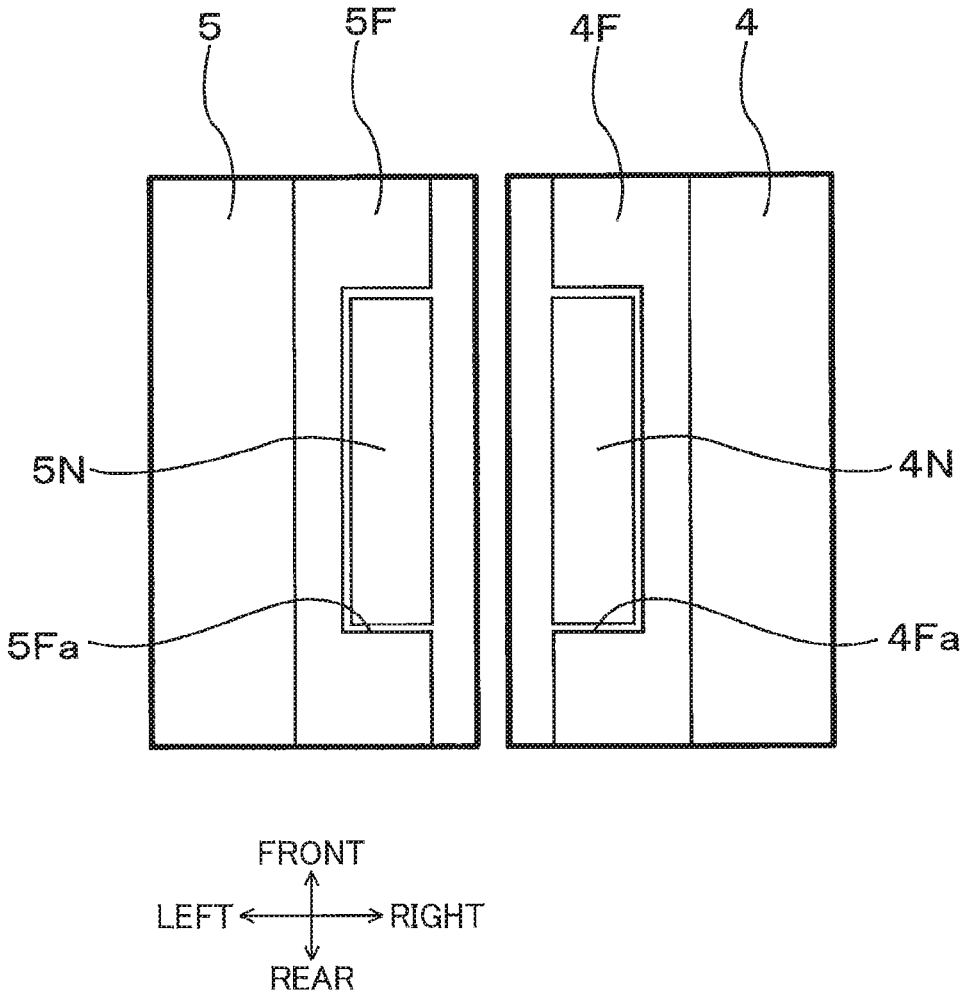
FIG. 5 is a schematic bottom view of liquid ejecting heads in the liquid ejecting device according to the first embodiment.

Next, a configuration of the ink cartridges 4 and 5 will be described in detail with reference to FIG. 5. First, the ink cartridge 4 includes a film circuit 4F positioned opposite to the neighboring ink cartridge 5 with respect to the ink nozzle portion 4N deviated toward the ink cartridge 5 in the left-right direction. In other words, the film circuit 4F has a portion deviated rightward relative to the ink nozzle portion 4N. In the present embodiment, only a center portion in the front-rear direction of the film circuit 4F is positioned opposite to the ink cartridge 5 with respect to the ink nozzle portion 4N in the left-right direction. Further, the film circuit 4F is formed with a notched portion 4Fa in which the ink nozzle portion 4N is positioned. The notched portion 4Fa has a rectangular shaped, for example. With this configuration, the position of the film circuit 4F as a whole is also deviated toward the ink cartridge 5, similar to the ink nozzle portion 4N.

The ink cartridge 5 includes a film circuit 5F positioned opposite to the neighboring ink cartridge 4 with respect to the ink nozzle portion 5N deviated toward the ink cartridge 4 in the left-right direction. That is, the film circuit 5F has a portion deviated leftward relative to the ink nozzle portion 5N. In the present embodiment, only a center portion in the front-rear direction of the film circuit 5F is positioned opposite to the ink cartridge 4 with respect to the ink nozzle portion 5N in the left-right direction. The film circuit 5F is formed with a notched portion 5Fa in which the ink nozzle portion 5N is positioned. Similar to the notched portion 4Fa, the notched portion 5Fa has a rectangular shaped. Hence, the position of the film circuit 5F as a whole is also deviated toward the ink cartridge 4, similar to the ink nozzle portion 5N.

The following advantageous effects can be obtained by virtue of the above-described configuration of the ink cartridges 4 and 5. In the ink cartridges 4 and 5 according to the first embodiment, the film circuits 4F and 5F can be positioned on the lower surface irrespective of the configurations where the ink nozzle portions 4N and 5N are deviated toward the neighboring ink cartridges 5 and 4, respectively. Accordingly, for positioning the ink nozzle portions 4N and 5N, it is unnecessary to increase in size of the ink cartridges 4 and 5 or increase in size of the film circuits 4F and 5F. Therefore, deviated positions of the ink nozzle portions 4N and 5N does not lead to affect the other components in the ink cartridges 4 and 5.

Incidentally, only one of the ink nozzle portions 4N and 5N of the ink cartridges 4 and 5 may be positioned to be deviated toward the remaining one of ink cartridges 4 and 5. In this case, of the two film circuits 4F and 5F, only one of the film circuits 4F and 5F may be positioned opposite to the remaining one of ink cartridges 4 and 5 with respect to the corresponding one of the ink nozzle portions 4N and 5N that is deviated toward the remaining one of ink cartridges 4 and 5.

For example, the position of the ink nozzle portion 4N may be deviated toward the ink cartridge 5 as described above, whereas the position of the ink nozzle portion 5N may not be deviated toward the ink cartridge 4. In the latter case, only the film circuit 4F may be formed to be positioned opposite to the ink nozzle portion 5N with respect to the ink nozzle portion 4N, and the film circuit 5F may not be positioned opposite to the ink nozzle portion 4N with respect to the ink nozzle portion 5N.

Figure 6:
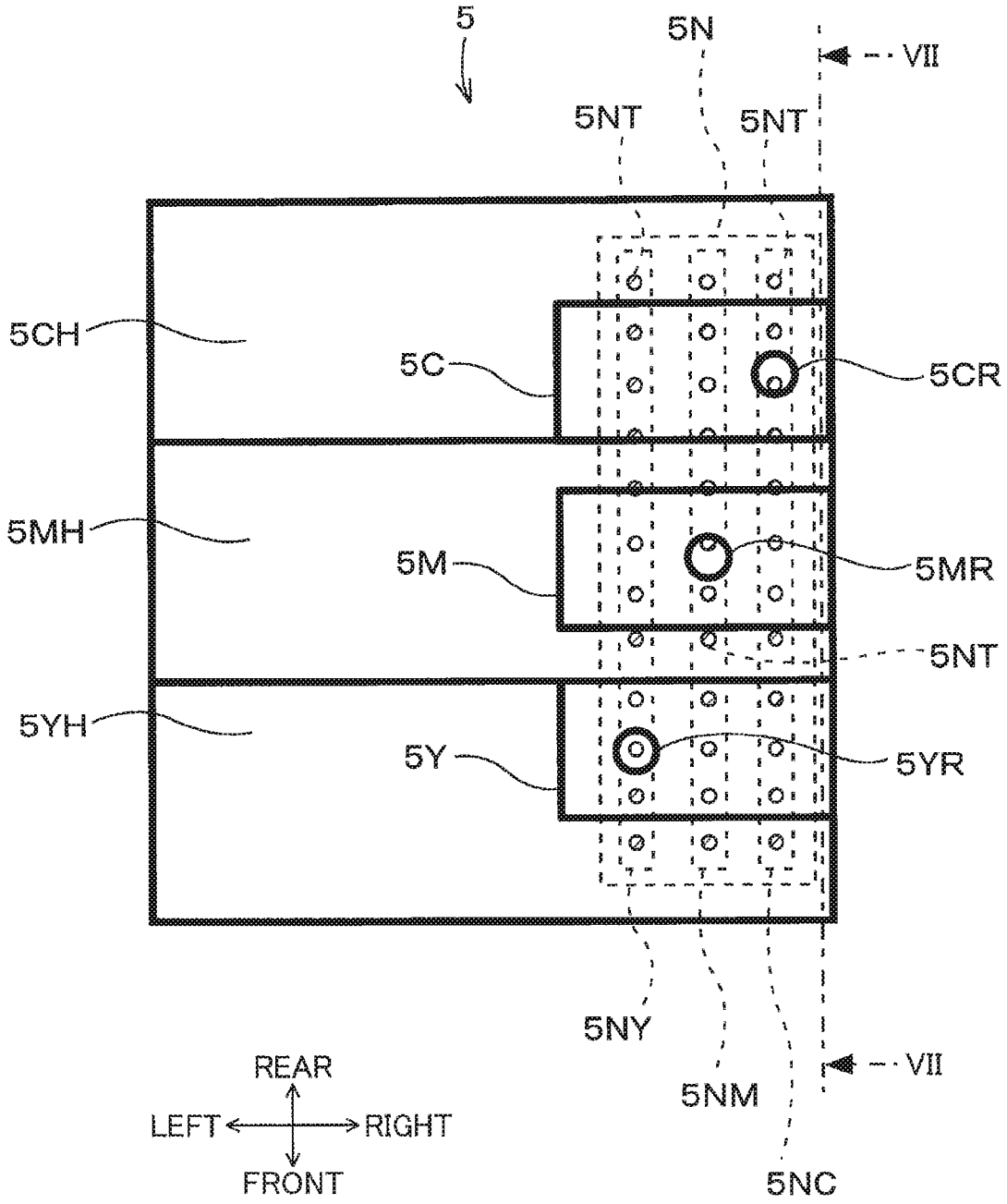
FIG. 6 is a schematic plan view illustrating an internal configuration of the liquid ejecting head in the liquid ejecting device according to the first embodiment.
Figure 7:
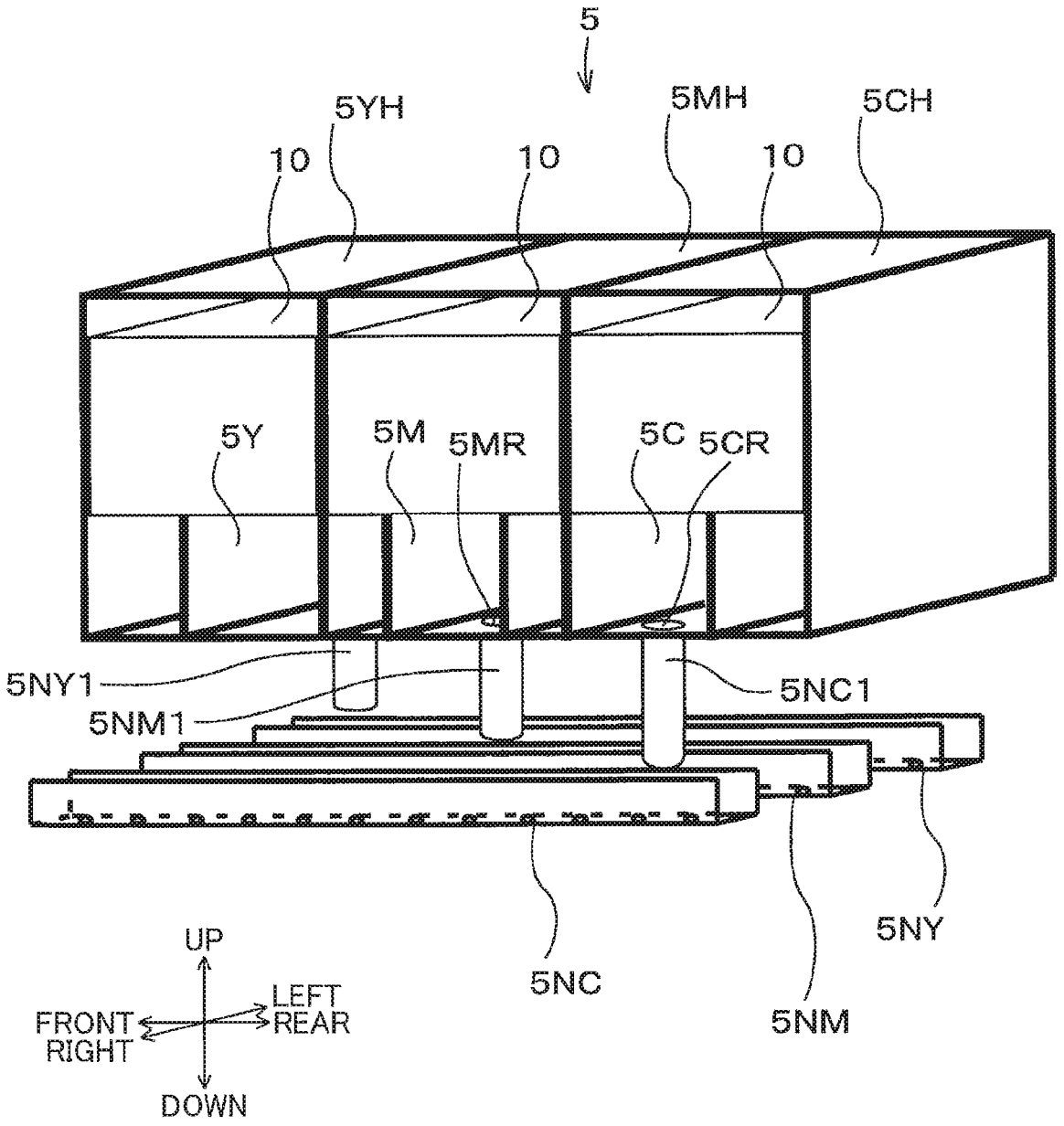
FIG. 7 is a schematic perspective view with a cross-section taken along the line VII-VII in FIG. 6 illustrating the internal configuration of the liquid ejecting head in the liquid ejecting device according to the first embodiment.

Next, an internal configuration of the ink cartridge 5 will be described in detail with reference to FIGS. 6 and 7. As described above, the ink cartridge 5 is configured to store therein a plurality of kinds of inks, i.e., cyan ink, magenta ink, and yellow ink. The internal space of the ink cartridge 5 is divided into a plurality of (three in the first embodiment) ink chambers 5CH, 5MH and 5YH. Each of the ink chambers 5CH, 5MH and 5YH stores therein a corresponding color of ink. In the present embodiment, cyan ink is stored in the ink chamber 5CH, magenta ink is stored in the ink chamber 5MH, and yellow ink is stored in the ink chamber 5YH. Each of the ink chambers 5CH, 5MH and 5YH is an example of a first storage portion.

A backpressure application portion 10 is positioned in each of the ink chambers 5CH, 5MH and 5YH. Each backpressure application portion 10 is made of an absorber capable of absorbing ink such as a sponge, a cavernous body, and a bundle of capillary tubes. Each of the backpressure application portion 10 is configured to absorb ink stored in the corresponding one of the ink chambers 5CH, 5MH and 5YH to apply backpressure, i.e., a negative pressure in the corresponding one of the ink chambers 5CH, 5MH and 5YH. The backpressure application portion 10 is an example of a negative pressure application portion.

Further, the ink cartridge 5 also includes a plurality of (three in the present embodiment) storage portions 5C, 5M and 5Y. The storage portion 5C is positioned within the ink chamber 5CH, the storage portion 5M is positioned within the ink chamber 5MH, and the storage portion 5Y is positioned within the ink chamber 5YH. Each of the storage portions 5C, 5M and 5Y is an example of a second storage portion.

The storage portion 5C is configured to store cyan ink flowing from the ink chamber 5CH. The storage portion 5C is formed with a passage opening 5CR. The storage portion 5M is configured to store magenta ink flowing from the ink chamber 5MH. The storage portion 5M is formed with a passage opening 5MR. The storage portion 5Y is configured to store yellow ink flowing from the ink chamber 5YH. The storage portion 5Y is formed with a passage opening 5YR. Each of the passage openings 5CR, 5MR and 5YR is an example of a passage opening.

Incidentally, the ink cartridge 4 includes an ink chamber (not illustrated), and a storage portion (not illustrated) positioned within the ink chamber and configured to store therein black ink. The storage portion of the ink cartridge 4 is formed with a passage opening (not illustrated).

The ink nozzle portion 5N has a plurality of nozzle openings 5NT for ejecting inks therethrough. A plurality of (three in the present embodiment) of nozzle arrays 5NC, 5NM and 5NY in which the nozzle openings 5NT are arrayed in line are arranged in the main scanning direction (i.e., the left-right direction) in a state where the ink cartridge 5 is mounted on the carriage 3. Further, in each of the nozzle arrays 5NC, 5NM and 5NY, the nozzle openings 5NT are arrayed in line in the sub scanning direction (i.e., the front-rear direction) in a state where the ink cartridge 5 is mounted on the carriage 3. Each of the nozzle arrays 5NC, 5NM and 5NY is an example of a second flow passage portion.

The nozzle array 5NC is connected to the passage opening 5CR of the storage portion 5C through a first passage portion 5NC1. The nozzle array 5NM is connected to the passage opening 5MR of the storage portion 5M through a first passage portion 5NM1. The nozzle array 5NY is connected to the passage opening 5YR of the storage portion 5Y through a first passage portion 5NY1. Each of the first passage portions 5NC1, 5NM1 and 5NY1 is an example of a first flow passage portion.

According to the ink cartridge 5 configured above, cyan ink stored in the storage portion 5C flows into the nozzle array 5NC through the passage opening 5CR and the first passage portion 5NC1, and is ejected through the nozzle openings 5NT in the nozzle array 5NC. Further, magenta ink stored in the storage portion 5M flows into the nozzle array 5NM through the passage opening 5MR and the first passage portion 5NM1, and is ejected through the nozzle openings 5NT of the nozzle array 5NM. Yellow ink stored in the storage portion 5Y flows into the nozzle array 5NY through the passage opening 5YR and the first passage portion 5NY1, and is ejected through the nozzle openings 5NT of the nozzle array 5NY.

In this ink cartridge 5, the storage portions 5C, 5M and 5Y are arrayed with each other in the sub scanning direction (a direction in which the nozzle openings 5NT are arrayed) perpendicular to the main scanning direction. Further, the passage openings 5CR, 5MR and 5YR are positioned offset from each other in the main scanning direction. Further, each of the storage portions 5C, 5M and 5Y is positioned directly above the ink nozzle portion 5N. Further, each of the passage openings 5CR, 5MR and 5YR is positioned directly above one nozzle opening 5NT of the corresponding one of nozzle arrays 5NC, 5NM and 5NY.

With the above configuration, the following advantageous effects can be exhibited. Specifically, in the above ink cartridge 5, the storage portions 5C, 5M and 5Y are arranged in the direction in which the plurality of nozzle openings 5NT are arrayed at a position directly above the ink nozzle portion 5N, and the passage openings 5CR, 5MR and 5YR are positioned to be offset from one another in the direction perpendicular to the direction in which the plurality of nozzle openings 5NT are arrayed. Accordingly, the plurality of storage portions 5C, 5M and 5Y can be aggregated in a compact manner toward the neighboring ink cartridge 4 while avoiding increase in size of the ink cartridge 5 as a whole, in spite of the configuration where the position of the ink nozzle portion 5N is deviated toward the neighboring ink cartridge 4.

Further, a length of each of the flow passages (i.e., first passage portions 5NC1, 5NY1 and 5NM1) connecting one of the passage openings 5CR, 5MR and 5YR to the corresponding one of nozzle arrays 5NC, 5NM and 5NY can be shortened, thereby lowering passage resistance of ink flowing through the flow passages to smoothly supply the ink.

Incidentally, "each of the plurality of storage portions 5C, 5M and 5Y is positioned directly above the ink nozzle portion 5N" denotes that the plurality of storage portions 5C, 5M and 5Y is overlapped with the ink nozzle portion 5N in a direction perpendicular to both the main scanning direction and the sub scanning direction, i.e., in an up-down direction of the liquid ejecting device 1. In other words, the plurality of storage portions 5C, 5M and 5Y is overlapped with the ink nozzle portion 5N in a plan view.

Note that the entire portion of the plurality of storage portions 5C, 5M and 5Y may be overlapped with the ink nozzle portion 5N in the up-down direction, or at least a portion of the plurality of storage portions 5C, 5M and 5Y may be overlapped with the ink nozzle portion 5N.

Further, "each of the plurality of passage openings 5CR, 5MR and 5YR is positioned directly above the corresponding one of nozzle arrays 5NC, 5NM and 5NY" denotes that each of the plurality of passage openings 5CR, 5MR and 5YR is overlapped with the corresponding one of nozzle arrays 5NC, 5NM and 5NY in the direction perpendicular to both the main scanning direction and the sub scanning direction, i.e., in the up-down direction of the liquid ejecting device 1. In other words, each of the plurality of passage openings 5CR, 5MR and 5YR is overlapped with the corresponding one of the plurality of nozzle arrays 5NC, 5NM and 5NY in the plan view.

Incidentally, the entire portion of each of the plurality of passage openings 5CR, 5MR and 5YR may be positioned to overlap with the corresponding one of nozzle arrays 5NC, 5NM and 5NY, or at least a portion of each of the plurality of passage openings 5CR, 5MR and 5YR may be overlapped with the corresponding one of nozzle arrays 5NC, 5NM and 5NY. That is, any configuration can be employed provided that at least a portion of each of the plurality of passage openings 5CR, 5MR and 5YR are overlapped with at least a portion of the corresponding one of nozzle arrays 5NC, 5NM and 5NY in the plan view.

With such a configuration, even if air accidentally enters the nozzle arrays 5NC, 5NM and 5NY through the nozzle openings 5NT, the air can be discharged out of the nozzle arrays 5NC, 5NM and 5NY into the corresponding storage portions 5C, 5M and 5Y through the passage openings 5CR, 5MR and 5YR without stagnating in the nozzle arrays 5NC, 5NM and 5NY or the first passage portions 5NC1, 5NM1 and 5NY1. This configuration can avoid occurrence of defects in ink ejection through the nozzle opening 5NT caused by stagnation of air in the nozzle arrays 5NC, 5NM and 5NY or the first passage portions 5NC1, 5NM1 and 5NY1.

Figure 8:
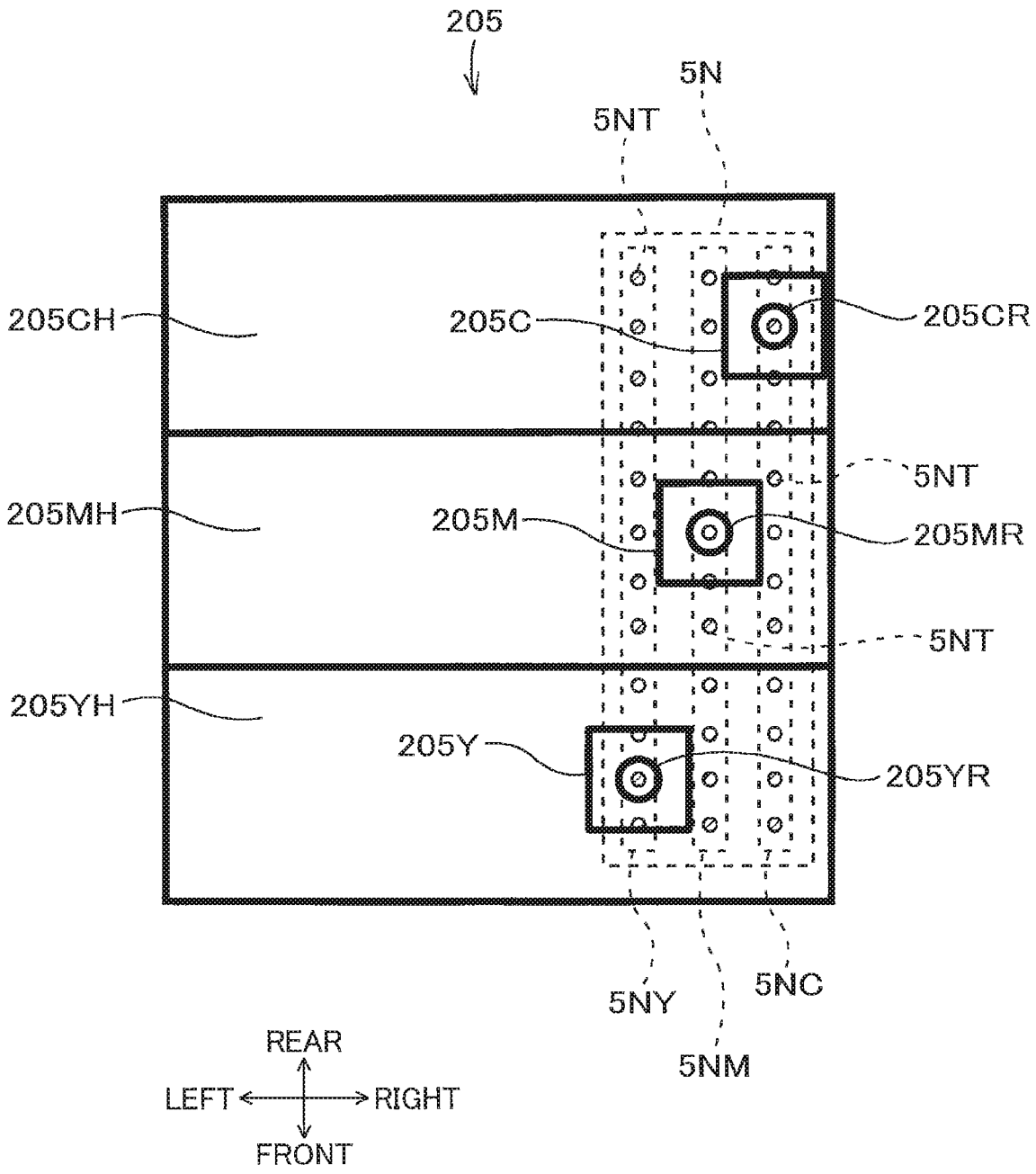
FIG. 8 is a schematic plan view illustrating an internal configuration of a liquid ejecting head in a liquid ejecting device according to a second embodiment.

Hereinafter, an ink cartridge 205 according to a second embodiment will be described with reference to FIG. 8, wherein like parts and components are designated by the same reference numerals as those shown in the first embodiment.

The ink cartridge 205 as an example of the liquid ejecting head has ink chambers 205CH, 205MH and 205YH, and storage portions 205C, 205M and 205Y provided in the ink chambers 205CH, 205MH, 205YH, respectively. The storage portion 205C is formed with a passage opening 205CR at a center portion thereof. The storage portion 205M is formed with a passage opening 205MR at a center portion thereof. The storage portion 205Y is formed with a passage opening 205YR at a center portion thereof. That is, in the second embodiment, the passage openings 205CR, 205MR and 205YR are formed at positions the same as one another in the corresponding storage portions 205C, 205M and 205Y. In other words, the passage openings 205CR, 205MR and 205YR are formed at center portions of the storage portions 205C, 205M and 205Y, respectively.

Further, the storage portion 205C is positioned in the ink chamber 205CH so that the passage opening 205CR is positioned directly above any one of the nozzle openings 5NT of the nozzle array 5NC. Similarly, the storage portion 205M is positioned in the ink chamber 205MH so that the passage opening 205MR is positioned directly above any one of the nozzle openings 5NT of the nozzle array 5NM, and the storage portion 205Y is positioned in the ink chamber 205YH so that the passage opening 205YR is positioned directly above any one of the nozzle openings 5NT of the nozzle array 5NY.

Even with the above configuration according to the second embodiment, any disadvantages caused by deviation of the ink nozzle portion 5N toward the neighboring ink cartridge 4 can be minimized. Accordingly, increase in size of the ink cartridge 205 can be avoided, and the length of the flow passage can be reduced to thereby realize smooth flowing of ink. Further, since each of the passage openings 205CR, 205MR and 205YR is positioned at the center portion of the corresponding one of storage portions 205C, 205M and 205Y, the ink cartridge 205 can suppress amount of ink flowing from the storage portions 205C, 205M and 205Y from varying in accordance with a direction in which the ink cartridge 205 is moved during the reciprocal movement of the carriage 3 can be restrained, thereby realizing stable ejection of inks.

Figure 9:
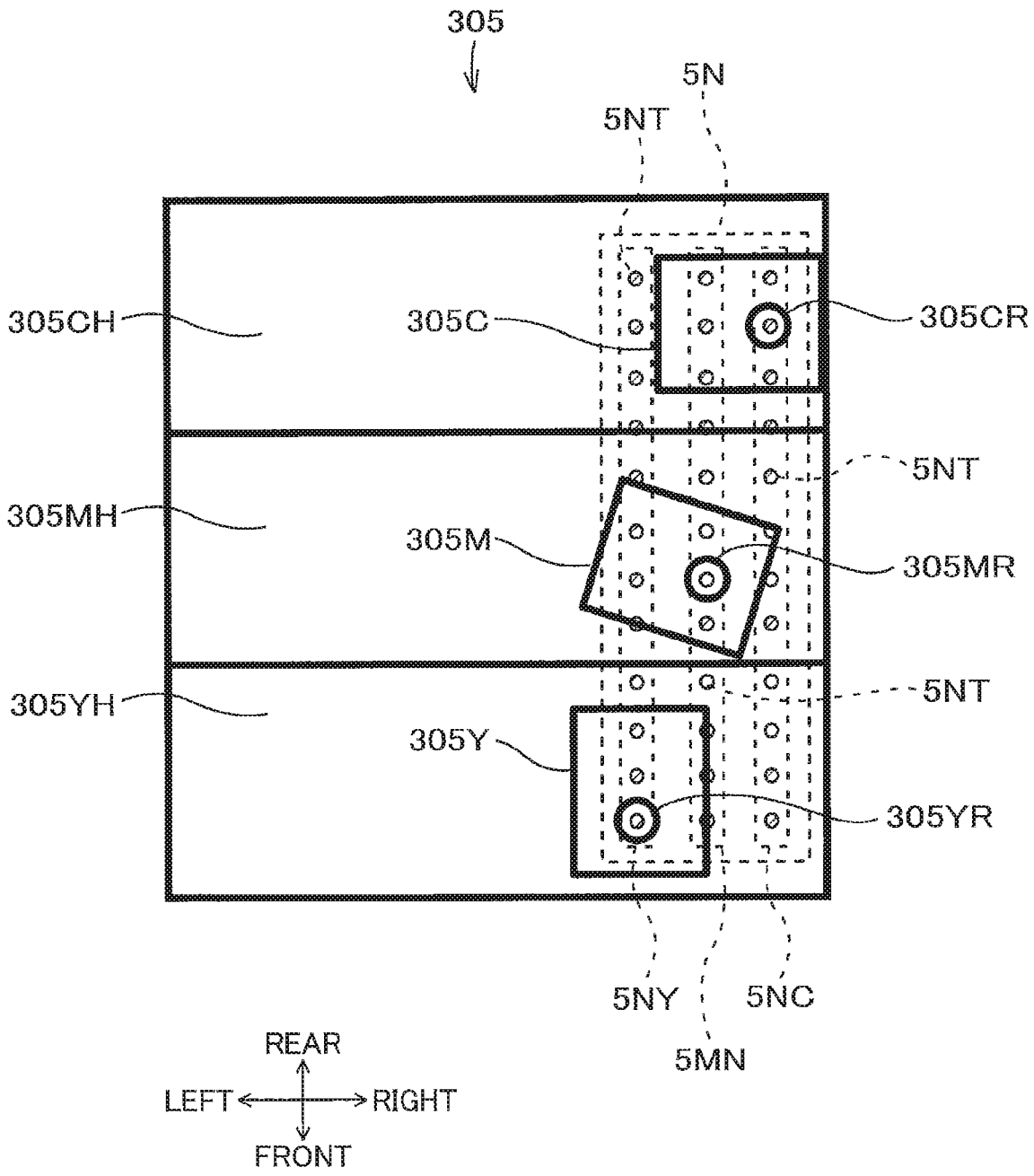
FIG. 9 is a schematic plan view illustrating an internal configuration of a liquid ejecting head in a liquid ejecting device according to a third embodiment.

An ink cartridge 305 according to a third embodiment will next be described with reference to FIG. 9 wherein like parts and components are designated by the same reference numerals as those shown in the first embodiment.

The ink cartridge 305 as an example of the liquid ejecting head has ink chambers 305CH, 305MH and 305YH, and storage portions 305C, 305M and 305Y provided in the ink chambers 305CH, 305MH and 305YH, respectively. Further, passage openings 305CR, 305MR and 305YR are formed in the storage portions 205C, 205M, 205Y, respectively. In the third embodiment, positions of the passage openings 305CR, 305MR and 305YR relative to the corresponding storage portions 305C, 305M and 305Y are identical to one another, and orientations of the storage portions 305C, 305M and 305Y are different from one another.

Even with the configuration according to the third embodiment, any disadvantages caused by deviation of the ink nozzle portion 5N toward the neighboring ink cartridge 4 can be minimized Hence, increase in size of the ink cartridge 305 can be avoided, and the length of the flow passage can be reduced to lead to smooth flowing of inks.

While the description has been made in detail with reference to the embodiments, it would be apparent to those skilled in the art that various changes and modifications may be made thereto.

Figure 10:
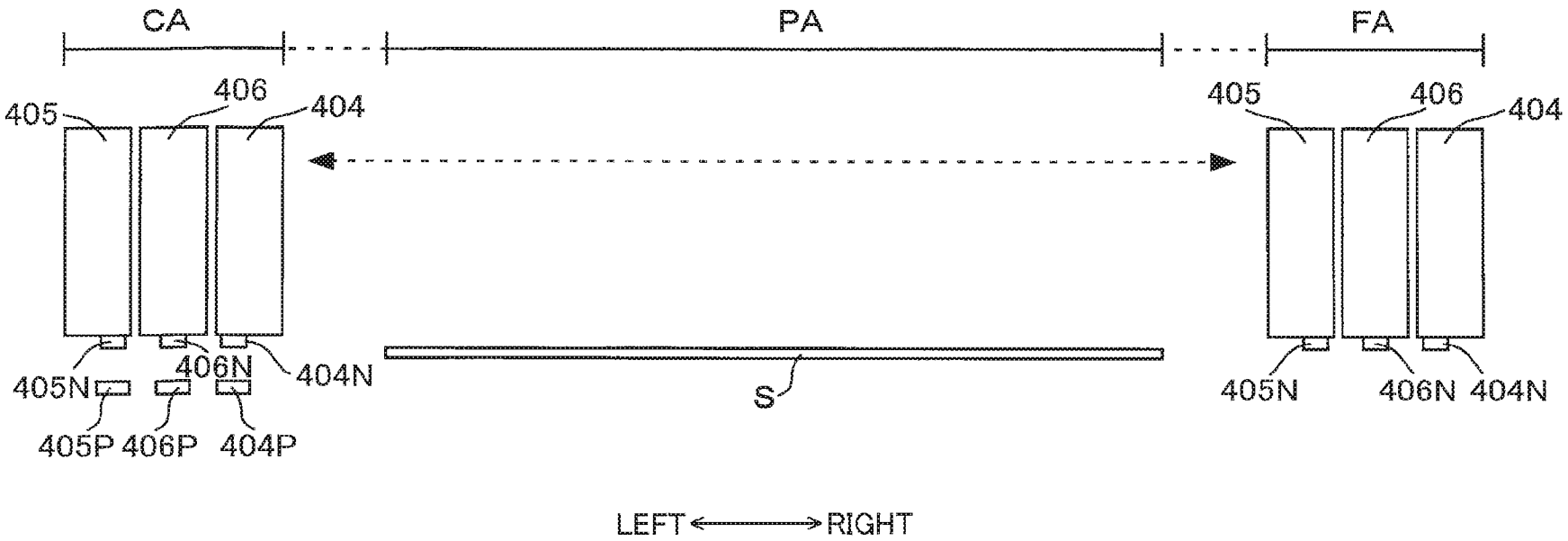
FIG. 10 is a schematic front view illustrating main components in a liquid ejecting device according to a modification.

For example, the liquid ejecting device 1 may be provided with three or more ink cartridges. FIG. 10 illustrates a modification in which three ink cartridges 404, 405 and 406 are provided in a liquid ejecting device. The ink cartridge 406 is interposed between the ink cartridges 404 and 405 in the left-right direction. Each of the ink cartridges 404 and 405 are examples of the endmost liquid ejecting head, the first endmost liquid ejecting head, and the second endmost liquid ejecting head.

The ink cartridge 404 has an ink nozzle portion 404N on a lower surface thereof at a position deviated toward the ink cartridge 405. The ink cartridge 405 has an ink nozzle portion 405N on a lower surface thereof at a position deviated toward the ink cartridge 404. The ink cartridge 406 has an ink nozzle portion 406N on a lower surface thereof at a center portion in the left-right direction of the ink cartridge 406. That is, the ink nozzle portion 406N of the ink cartridge 406 is not positioned to be deviated toward the ink cartridge 404 of the ink cartridge 405. Further, a cap 404P for covering the ink nozzle portion 404N, a cap 405P for covering the ink nozzle portion 405N, and a cap 406P for covering the ink nozzle portion 406N are provided in the capping region CA.

According to this modification, sufficient accelerating region VA for the ink cartridges 404, 405 and 406 to accelerate the ink cartridges 404, 405 and 406 can be provided while avoiding increase in a length of reciprocally moving range of the ink cartridges 404, 405 and 406. In other words, sufficient accelerating region VA of the ink cartridges 404, 405 and 406 can be provided without incurring increase in size of the liquid ejecting device 1. Note that the number of the intermediate liquid ejecting head(s) interposed between the two endmost liquid ejecting heads (in this modification, the ink cartridge 406) can be increased as long as the position of the liquid ejecting portion(s) of the endmost liquid ejecting head(s) is deviated toward the remaining endmost liquid ejecting head.

Further, the liquid ejecting device 1 can be modified such that the ink nozzle portion of at least one of the plurality of ink cartridges is positioned to be deviated toward the remaining ink cartridges.

Further, the liquid ejecting device 1 can be modified such that the ink nozzle portion of only the ink cartridge positioned closest to the image forming region PA among the plurality of ink cartridges in the capping region CA may be deviated toward the other ink cartridges.

Further, the liquid ejecting device 1 can be modified such that the ink nozzle portion of only the ink cartridge positioned closest to the image forming region PA among the plurality of ink cartridges in the flushing region FA may be deviated toward the other ink cartridges.

Further, in the second and third embodiments described above, the passage openings are formed at positions the same as one another in the corresponding storage portions. Specifically, the passage openings are formed at the center portions of the corresponding storage portions. However, in a case where the configuration where the passage openings are formed at positions the same as one another is employed, the passage openings may not be formed at the center portions, and may be formed at corner portions of the corresponding storage portions, for example.

Further, a concept of the present disclosure may not only be applied to a device that forms an image using ink, but also be applied to a device that forms an image using liquid other than ink.

What is claimed is:

1. A liquid ejecting device comprising:

a carriage reciprocally movable in a main scanning direction;

a first liquid cartridge comprising a first liquid ejecting portion; and a second liquid cartridge comprising a second liquid ejecting portion, the first liquid cartridge and the second liquid cartridge being detachably mounted on the carriage, the second liquid cartridge being detachably mounted on the carriage independently from the first liquid cartridge, wherein:

a center in the main scanning direction of the first liquid ejecting portion is closer to the second liquid cartridge than a center in the main scanning direction of the first liquid cartridge is to the second liquid cartridge; and a center in the main scanning direction of the second liquid ejecting portion is closer to the first liquid cartridge than a center in the main scanning direction of the second liquid cartridge is to the first liquid cartridge.

2. The liquid ejecting device according to claim 1, wherein the first liquid cartridge comprises a first film circuit having a portion positioned opposite to the second liquid cartridge with respect to the first liquid ejecting portion.

3. A liquid ejecting device comprising:

a plurality of liquid ejecting heads reciprocally movable in a main scanning direction and arrayed in the main scanning direction, each of the plurality of liquid ejecting heads comprising a liquid ejecting portion configured to eject liquid, the plurality of liquid ejecting heads comprising:

a first endmost liquid ejecting head constituting one end in the main scanning direction of the plurality of liquid ejecting heads; and a second endmost liquid ejecting head constituting another end in the main scanning direction of the plurality of liquid ejecting heads, wherein the liquid ejecting portion of at least one of the first endmost liquid ejecting head and the second endmost liquid ejecting head is disposed at a position deviated toward the remaining one of the first endmost liquid ejecting head and the second endmost liquid ejecting head, wherein the at least one of the first endmost liquid ejecting head and the second endmost liquid ejecting head comprises:

a plurality of first storage portions, each of the plurality of first storage portions storing therein the liquid;

a plurality of negative pressure application portions, each of the plurality of negative pressure application portions being configured to apply negative pressure to the liquid stored in a corresponding one of the plurality of first storage portions; and a plurality of second storage portions, each of the plurality of second storage portions being configured to store the liquid flowing from the corresponding one of the plurality of first storage portions, wherein the liquid ejecting portion comprises a plurality of nozzle openings arrayed in line in a sub scanning direction perpendicular to the main scanning direction, and wherein the plurality of second storage portions are arrayed in the sub scanning direction.

4. The liquid ejecting device according to claim 3, wherein the at least one of the first endmost liquid ejecting head and the second endmost liquid ejecting head further comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, and wherein the plurality of passage openings are positioned offset from each other in the main scanning direction.

5. The liquid ejecting device according to claim 4, wherein the at least one of the first endmost liquid ejecting head and the second endmost liquid ejecting head further comprises:

a plurality of second flow passages, each of the plurality of second flow passages allowing the liquid flowing from the corresponding one of the plurality of first flow passages to flow into the plurality of nozzle openings therethrough, and wherein each of the plurality of passage openings has at least a portion overlapped with a corresponding one of the plurality of second flow passages in a direction perpendicular to the main scanning direction and the sub scanning direction.

6. The liquid ejecting device according to claim 3, wherein the at least one of the first endmost liquid ejecting head and the second endmost liquid ejecting head further comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, wherein the plurality of passage openings are formed at positions identical to each other with respect to the plurality of second storage portions, and wherein the plurality of second storage portion are oriented in directions different from each other.

7. The liquid ejecting device according to claim 3, wherein the at least one of the first endmost liquid ejecting head and the second endmost liquid ejecting head further comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, and wherein each of the plurality of passage openings is formed at a center portion of a bottom surface of the corresponding one of the plurality of second storage portions.

8. A liquid ejecting device comprising:

a carriage reciprocally movable in a main scanning direction;

a first liquid cartridge comprising a first liquid ejecting portion, the first liquid cartridge being detachably mounted on the carriage; and a second liquid cartridge comprising a second liquid ejecting portion, the second liquid cartridge being detachably mounted on the carriage independently from the first liquid cartridge, wherein the first liquid cartridge and the second liquid cartridge are movable at least between:

an image forming region in which each of the first liquid ejecting portion and the second liquid ejecting portion ejects liquid; and a capping region, wherein the liquid ejecting device further comprises:

a first cap provided at the capping region and configured to cover the first liquid ejecting portion; and a second cap provided at the capping region and configured to cover the second liquid ejecting portion, wherein, in a state where the first liquid cartridge and the second liquid cartridge are positioned in the capping region, the first liquid cartridge is positioned closer to the image forming region in the main scanning direction than the second liquid cartridge is to the image forming region, and wherein a center in the main scanning direction of the first liquid ejecting portion is closer to the second liquid cartridge than a center in the main scanning direction of the first liquid cartridge is to the second liquid cartridge.

9. The liquid ejecting device according to claim 8, wherein the first liquid cartridge comprises a first film circuit having a portion positioned opposite to the second liquid cartridge with respect to the first liquid ejecting portion.

10. A liquid ejecting device comprising:

a plurality of liquid ejecting heads reciprocally movable in a main scanning direction and arrayed in the main scanning direction, each of the plurality of liquid ejecting heads comprising a liquid ejecting portion configured to eject liquid, the plurality of liquid ejecting heads being movable at least between:

an image forming region in which each of plurality of liquid ejecting heads ejects the liquid; and a capping region, the plurality of liquid ejecting heads comprising:

a first liquid ejecting head comprising a first liquid ejecting portion; and a second liquid ejecting head comprising a second liquid ejecting portion; and a plurality of caps provided at the capping region and configured to cover the liquid ejecting portion of a corresponding one of the plurality of liquid ejecting heads, wherein, in a state where the plurality of liquid ejecting heads are positioned in the capping region, the first liquid ejecting head is positioned closer to the image forming region in the main scanning direction than the second liquid ejecting head is to the image forming region, wherein the first liquid ejecting portion is at a position deviated toward the second liquid ejecting head, wherein the first liquid ejecting head comprises:

a plurality of first storage portions, each of the plurality of first storage portions storing therein the liquid;

a plurality of negative pressure application portions, each of the plurality of negative pressure application portions being configured to apply negative pressure to the liquid stored in a corresponding one of the plurality of first storage portions; and a plurality of second storage portions, each of the plurality of second storage portions being configured to store the liquid flowing from the corresponding one of the plurality of first storage portions, wherein the liquid ejecting portion comprises a plurality of nozzle openings arrayed in line in a sub scanning direction perpendicular to the main scanning direction, and wherein the plurality of second storage portions are arrayed in the sub scanning direction.

11. The liquid ejecting device according to claim 10, wherein the first liquid ejecting head further comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, and wherein the plurality of passage openings are positioned offset from each other in the main scanning direction.

12. The liquid ejecting device according to claim 11, wherein the first liquid ejecting head further comprises:

a plurality of second flow passages, each of the plurality of second flow passages allowing the liquid flowing from the corresponding one of the plurality of first flow passages to flow into the plurality of nozzle openings therethrough, and wherein each of the plurality of passage openings has at least a portion overlapped with a corresponding one of the plurality of second flow passages in a direction perpendicular to the main scanning direction and the sub scanning direction.

13. The liquid ejecting device according to claim 10, wherein the first liquid ejecting head comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, wherein the plurality of passage openings are formed at positions identical to each other with respect to the plurality of second storage portions, and wherein the plurality of second storage portion are oriented in directions different from each other.

14. The liquid ejecting device according to claim 10, wherein the first liquid ejecting head comprises:

a plurality of first flow passages, each of the plurality of first flow passages being connected to a corresponding one of the plurality of second storage portions and allowing the liquid stored in the corresponding one of the plurality of second storage portions to flow into the plurality of nozzle openings therethrough, wherein the plurality of second storage portions are formed with a plurality of passage openings in one-to-one correspondence, each of the plurality of passage openings allowing the liquid stored in the corresponding one of plurality of second storage portions to flow into corresponding one of plurality of first flow passages, and wherein each of the plurality of passage openings is formed at a center portion of a bottom surface of the corresponding one of the plurality of second storage portions.

* * * * *